United States Patent [19]

Mehdorn et al.

[11] 4,391,025

[45] Jul. 5, 1983

[54] PROCESS FOR LAYING DOWN CONTINUOUS MATERIAL

[75] Inventors: Frank R. Mehdorn, Steppach; Johann Seelig, Schwabmünchen, both of Fed. Rep. of Germany

[73] Assignee: Hoechst Aktiengesellschaft, Fed. Rep. of Germany

[21] Appl. No.: 178,740

[22] Filed: Aug. 18, 1980

[30] Foreign Application Priority Data

Aug. 22, 1979 [DE] Fed. Rep. of Germany ..... 2933963

[51] Int. Cl.[3] ..... B65H 54/80

[52] U.S. Cl. ..... 28/289; 53/429

[58] Field of Search ..... 28/278, 280, 289; 226/119, 104, 105; 242/47.06, 47.07; 223/32; 53/116, 429

[56] References Cited

U.S. PATENT DOCUMENTS

| | | | |
|---|---|---|---|
| 3,530,556 | 9/1970 | Hole | 28/280 |
| 3,921,268 | 11/1975 | Caroglio | 28/278 |

FOREIGN PATENT DOCUMENTS

| | | | |
|---|---|---|---|
| 9218 | 4/1980 | European Pat. Off. . | |
| 2655733 | 6/1978 | Fed. Rep. of Germany . | |
| 2840123 | 2/1980 | Fed. Rep. of Germany | 226/119 |
| 44-30460 | 12/1969 | Japan | 28/280 |
| 46-33423 | 9/1971 | Japan | 28/280 |
| 1211681 | 11/1970 | United Kingdom | 28/100 |
| 499200 | 3/1976 | U.S.S.R. | 28/289 |

*Primary Examiner*—Robert Mackey

*Attorney, Agent, or Firm*—Connolly and Hutz

[57] ABSTRACT

An apparatus is described for laying down continuous material 15, for example filament tows, which runs on a determined level, from which level it is given a meander form by means of a turning wheel 1, the periphery of which is provided with reversing elements 2.

Forming of meanders from the continuous material 15 is performed by means of one single wheel 1. Catching devices 5 are provided between the reversing elements 2 which, from the outside of the plane of running continuous material 15, slue into this plane and by this inward motion form meanders of the running continuous material 15, and subsequently slue back from the plane of the continuous material 15 to their initial position, thus releasing the meanders of continuous material 15 formed for being laid down. The catching devices 5 can be arranged on forks 4 which slide in guide grooves 3 in the wheel 1, and the forks 4 can be driven by slide rods 10, whose motion cycle is determined by a cam disk 13.

1 Claim, 3 Drawing Figures

PROCESS FOR LAYING DOWN CONTINUOUS MATERIAL

The invention provides a process for laying down continuous material running on a determined level, which comprises giving the continuous material a meander form on the surface of a rotating wheel, the periphery of which is provided with reversing elements, and subsequently laying it down.

Devices of this type are used, for example, in the manufacture of synthetic staple fibers when the filament bundles drawn off from a relatively large number of melt-spinning nozzles are combined to form a tow and subsequently are laid down in large spinning cans.

A process for laying down spinning tows must reduce the speed of the spinning tow before it is laid down in the spinning can, because the high momentum of the tow must be annihilated instantaneously when the tow strikes the material already laid down since otherwise the tow opens up and splays, which results in randomization and intertwining of the filaments. When the tow is again drawn out of the spinning can, this type of laying down causes difficulties in running out, filament damage and uneven stretching, which becomes manifest in deviations of the textile-technological data, such as differences in dyeing. In the most unfavorable case, the tow, on impingement in the spinning can, can even be severely damaged to such an extent that it cannot be processed further.

The necessary speed reduction can for example be effected by a sinusoidal deformation with the aid of a pair of profiled rolls.

In order to attain a corresponding reduction in the case of high feeding speed of the spinning tow, there has been proposed in German Offenlegungsschrift No. 2,840,123 a device consisting of a pair of rolls, on the surface of which teeth are periodically arranged and the peripheral zones of which form an engagement zone having two boundary planes. In this device, the teeth of one roll are held in the annular working zone of this roll from the outside of that side of one boundary plane which faces away from the engagement zone, and the teeth of the other roll are held in their annular working zone from the outside of the other side of the other boundary plane. Such a pair of rolls requires much space, and the two rolls must be very precisely synchronized, which requirements demand a complicated design and a corresponding service expenditure. The necessary meanders of the continuous material arriving in a straight line are formed in a short section of the circular arc having an angle of less than 60° (60° correspond to the theoretically maximal engagement e=r radius of the roll).

It is the object of the present invention to overcome these disadvantages, that is, to make synchronization of a pair of profiled rolls superfluous and to allow formation of meanders over a section having a large angle, while on the other hand the advantages of the roll provided with periodically arranged guide pins or teeth are maintained.

In accordance with the invention, this object is achieved in a process of the above kind by using one single wheel for the formation of the meanders, by providing catching devices between the reversing elements which, from the outside of the plane of running continous material, slue into this plane and by this inward motion form meanders of the running continuous material, and subsequently slue back from the plane of the continuous material to their initial position, thus releasing the meanders of continuous material formed for being laid down. Preferably, the motion of the catching devices is controlled by mechanical means.

According to an advantageous embodiment of the process of the invention, each catching device is arranged on a fork sliding in a guide groove in the wheel; the fork being fastened to the wheel via a first joint, a connecting rod and a pillow block. The catching device is driven via a second joint by a slide rod which slides in a corresponding track; the motion cycle of the slide rod being determined by a cam disk via a cam roller.

The invention will be better understood by reference to the accompanying drawings showing an example of an exclusively mechanical embodiment. The plane of running continuous material corresponds to the level of the bundle of parallelly running filaments, so that this plane is formed by any one of the multitude of filament components of the continuous material.

The numbers in the drawings have the following meanings:

1—wheel
2—reversing element
3—guide grooves
4—fork
5—catching device
6—first joint
7—connecting rod
8—pillow block
9—plane of running filaments
10—slide rod
11—second joint
12—cam roller
13—cam disk
14—track for slide rod
15—continuous material
L—feed rollers FIG. 1 of the accompanying drawings is a schematic front elevation showing the process of the invention.

Figure 1:
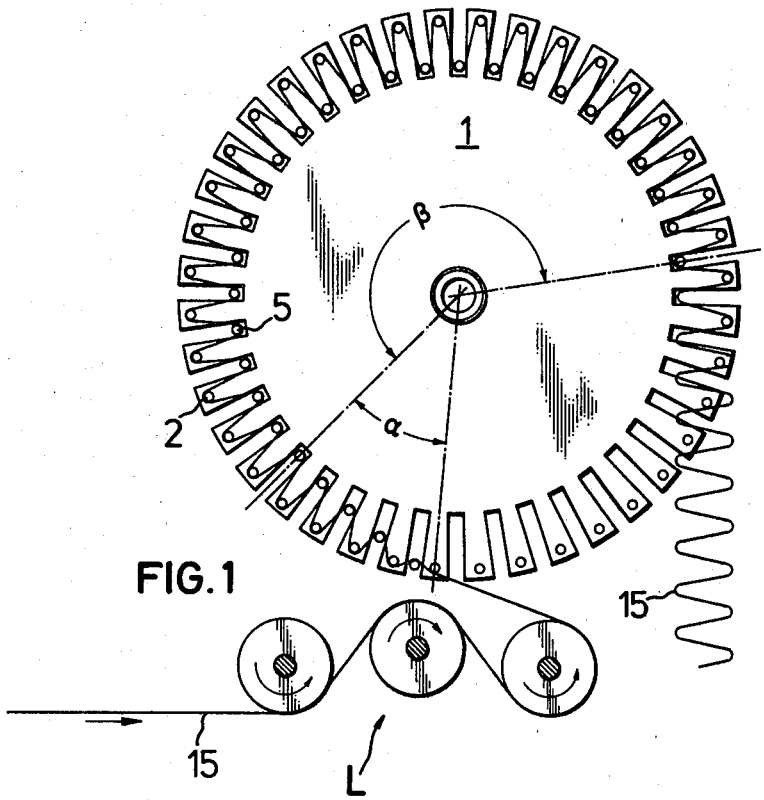
Figure 2:
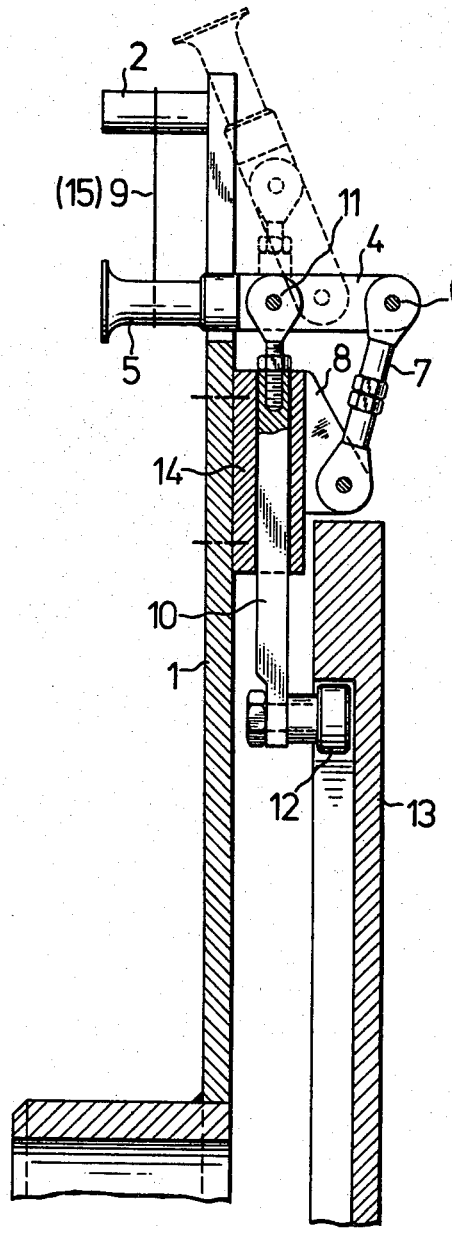
FIG. 2 shows section II—II of FIG. 3.
Figure 3:
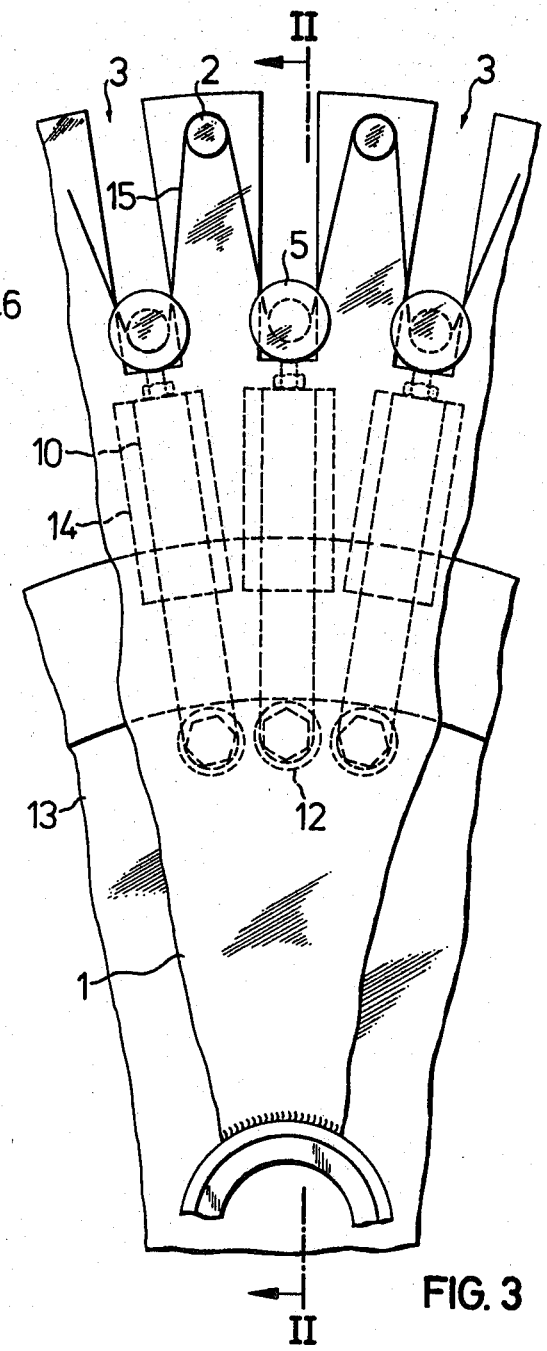
FIG. 3 is a fragmented enlarged sectional view of the embodiment shown in FIG. 1 showing a purely mechanical apparatus for carrying out the process of the invention.

As reversing elements elements 2, forty solidly fixed reversing pins are arranged uniformly on the perpendicularly positioned wheel 1, in general in the plane parallel to the axis of this wheel. In this embodiment, the reversing elements 2 have a circular cross-section, and they may be hollow or solid bodies. In the example of the drawings, the reversing elements 2 are rigidly fixed to the wheel 1. Their surface is generally wear resistant. The width of these reversing elements 2 is adapted in each case to the corresponding apparatus and the continuous material 15 to be laid down, while according to German Offenlegungsschrift No. 2,840,123 for the pair of profiled rolls, pins having a small radial extension only can be used in order to allow a large engagement. With increasing wheel diameter, more reversing pins can be mounted, thus increasing tractive force and engagement.

Between these reversing elements 2, forty corresponding guide grooves 3 are shaped in the wheel 1. A catching device 5 can slide through the corresponding guide groove. This catching device 5 is fixed via a first joint 6 to a connecting rod 7 which for its part is pivoted in a pillow block 8 attached to the wheel 1. Due to this kind of bearing, the catching device 5 slues from the right into the plane of running filaments 9 and simultaneously moves radially inwards in the direction of the axis of the wheel 1. This motion of the catching device 5 is produced by a slide rod 10 sliding in corresponding track 14 and connected to it via a second joint 11. The slide rod 10 is provided at its other end with a cam roller 12 running in a perpendicular cam disk 13 when the wheel 1 turns. Thus, the cam disk 13 controls the motion of the catching device 5. A fork 4 is located in each guide groove 3. For clarity, only the background leg of fork 4 is shown.

Generally, the catching device 5 has a hooked shape, so that, on penetration into the plane of running filaments 9, the continuous material 15 is radially driven inwards. In the drawings, this catching device is rotationally symmetric, but this is not absolutely necessary. Generally, its surface is wear resistant.

In the example of the drawings, the cam roller 12, on rotation of the wheel 1, is pressed to the cam disk 13 due to the centrifugal force. The shape of the cam disk 13 is designed in each case according to the requirements of the equipment in question.

FIG. 1 illustrates how the continuous material 15 to be laid down is conveyed by means of feed rolls L and the pins 2 and 5 of the wheel 1. The wheel in accordance with the invention produces meander formation of the continuous material 15, and thus a corresponding speed reduction.

In the case of the pair of profiled rolls according to the state of the art, deposition of the continuous material 15 onto the apparatus is a very difficult operation. In the case of the wheel 1 in accordance with the invention, however, the continuous material 15 supplied, for example a spinning tow, is tangentially deposited on the rotating wheel 1. The spinning tow is then seized by a catching device 5 and, while the wheel 1 turns at an angle $\alpha$, the size of which is determined by the design of the cam disk 13, taken inwards and given a meander form. Subsequently, the spinning tow is conveyed in meander form over the section of an angle $\beta$.

The distance between reversing element 2 and catching device 5 corresponds to the engagement of the pair of profiled rolls according to German Offenlegungsschrift No. 2,840,123. When the meanders take a horizontal position, the catching device 5 slues back from the plane of running filaments 9 and thus releases the meanders which are laid down in the spinning can at a speed reduced in dependence on their change in shape.

Formation of the meanders, that is, slueing of the catching device 5 from its position outside of the plane of running filaments 9 according to the broken line in the drawings to its position according to the continuous line of the drawings can extend over a relatively large circular arc when, for example, according to FIG. 1, the spinning tow is fed to the lower end of the wheel 1, and conveyed by the wheel 1 over 270°.

The apparatus according to the invention, as shown in the drawings, is not balanced, because the motion of catching devices 5 and wheel 1 causes a motion of masses relative to the center of the wheel. This unbalanced state can be overcome in known manner by a suitable design of the fork 4 and the connecting rod 7. These pieces have to be shaped, however, in such a manner that, on motion by means of slide rod 10, the gravity center of the moving pieces is maintained.

The process of the invention is especially suitable for laying down fiber tows obtained in high-speed spinning. In contrast to the pairs of profiled rolls according to the state of the art, the wheel in accordance with the invention ensures increased meander formation of the continuous material (i.e. increased catching), and thus a steep reduction of speed. The continuous material is further conveyed in meander form, thus ensuring a uniform tension between feed device and lay-down device. In the same manner, high tension of the continuous material, for example a spinning tow, is obtained, so that the wheel in accordance with the invention can be arranged directly after the spinnerets without any further feed device, in order to ensure godet-free spinning of fiber tows. As already described, the wheel with catching devices in accordance with the invention allows easy feeding and deposition of the spinning tow and thus trouble-free operations.

The lay-down apparatus in accordance with the invention is therefore a mechanically stable equipment easy to handle, which allows high reduction of speed and thus high-speed spinning of fiber tows with or without draw-off godets.

We claim:

1. An apparatus for forming meanders in a continuous spinning tow running in a plane comprising a single rotating wheel and meander-forming and -releasing means comprising:

reversing elements (2) arranged generally in a circle on the surface and around the periphery of the wheel (1) and, between each pair of reversing elements (2), a guide groove (3) in wheeel (1) for guiding a catching device (5);

movable catching devices (5), each catching device (5) arranged on a fork (4) sliding in a guide groove (3), and mechanical actuating means for the catching devices (5), each catching device (5) having an initial position, outside of the plane in which the continuous spinning tow is running and in closely spaced relation to the periphery of the wheel, and being movable from this initial position radially inwardly toward the axis of the wheel and into said plane; each fork (4) being fastened to the wheel (1) via a first joint (6), a connecting rod (7), and a pillow block (8);

said mechanical actuating means including means for:

sequentially moving the catching devices (5) to a relatively radially inward position from their initial position while also moving the catching devices into the plane in which the spinning tow is running thereby catching the spinning tow and forming a first meander of a sequential series of meanders in said spinning tow, each meander extending from a reversing element (2) to a catching device (5) which is in the relatively radially inward position, and moving each catching device (5) back toward its initial position after the catching device has rotated more than 60° of the circumference of the wheel (1), thereby releasing the meander;

the actuating means for each catching device (5) including a slide rod (10) for driving each fork (4) via a second joint (11); the slide rod (10) sliding in a corresponding track (14), and the motion cycle of the slide rod (10) being determined by a cam disk (13) via a cam roller (12).

* * * * *